US008529712B2

(12) United States Patent
Demetriou et al.

(10) Patent No.: US 8,529,712 B2
(45) Date of Patent: Sep. 10, 2013

(54) TOUGH IRON-BASED BULK METALLIC GLASS ALLOYS

(75) Inventors: Marios D. Demetriou, Los Angeles, CA (US); William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 237 days.

(21) Appl. No.: 12/783,007

(22) Filed: May 19, 2010

(65) Prior Publication Data

US 2010/0300148 A1 Dec. 2, 2010

Related U.S. Application Data

(60) Provisional application No. 61/179,655, filed on May 19, 2009.

(51) Int. Cl.
*C22C 45/02* (2006.01)

(52) U.S. Cl.
USPC ..... 148/541; 148/561; 148/403; 420/87; 420/88

(58) Field of Classification Search
USPC ..... 148/304, 403
See application file for complete search history.

(56) References Cited

U.S. PATENT DOCUMENTS 5,961,745 A * 10/1999 Inoue et al. ..... 148/304
6,077,367 A * 6/2000 Mizushima et al. ..... 148/561
2004/0140016 A1* 7/2004 Sakamoto et al. ..... 148/304
2006/0254386 A1* 11/2006 Inoue et al. ..... 75/246
2010/0096045 A1* 4/2010 Sato ..... 148/304
2012/0073710 A1* 3/2012 Kim et al. ..... 148/548

FOREIGN PATENT DOCUMENTS

| | | |
|---|---|---|
| EP | 0747498 | 12/1996 |
| JP | 11-071657 | 3/1999 |
| JP | 11-293427 | 10/1999 |
| JP | 2005-264260 | 9/2005 |
| JP | 2005-290468 | 10/2005 |
| KR | 10-0582579 | 5/2006 |
| KR | 10-2009-0038016 | 4/2009 |
| WO | WO 99/02748 | 1/1999 |

OTHER PUBLICATIONS

International Search Report and Written Opinion dated Dec. 29, 2010, PCT/US2010/035382, 7 pages.

Gu et al., "Ductility improvement of amorphous steels: roles of shear modulus and electronic structure," *Acta Materialia*, 2008, 56:88-94.

Makino et al., "Fe-Metalloid Metallic Glasses with High Magnetic Flux Density and High Glass-Forming Ability," *Materials Science Forum*, 2007, 561-565:1361-1366.

* cited by examiner

*Primary Examiner* — George Wyszomierski
(74) *Attorney, Agent, or Firm* — Dorsey & Whitney LLP

(57) ABSTRACT

A family of iron-based, phosphor-containing bulk metallic glasses having excellent processibility and toughness, methods for forming such alloys, and processes for manufacturing articles therefrom are provided. The inventive iron-based alloy is based on the observation that by very tightly controlling the composition of the metalloid moiety of the Fe-based, P-containing bulk metallic glass alloys it is possible to obtain highly processable alloys with surprisingly low shear modulus and high toughness.

27 Claims, 4 Drawing Sheets

TOUGH IRON-BASED BULK METALLIC GLASS ALLOYS

CROSS-REFERENCE TO RELATED APPLICATION

The current application claims priority to U.S. Provisional Application No. 61/179,655, filed May 19, 2009, the disclosure of which is incorporated herein by reference.

FIELD OF THE INVENTION

This invention relates generally to an iron-based bulk metallic glass alloy; and more particularly to a family of iron-based phosphor containing bulk metallic glass alloys exhibiting low shear moduli.

BACKGROUND OF THE INVENTION

The remarkably high strength, modulus, and hardness of iron-based glasses, combined with their low cost, prompted an effort over the last five years to design amorphous steel suitable for structural applications. The alloy development effort yielded glasses with critical rod diameters as large as 12 mm and strengths in excess of 4 GPa. (See, e.g., Lu Z P, et al., Phys Rev Lett 2004: 92; 245503; Ponnambalam V, et al., J Mater Res 2004: 19; 1320; and Gu X J, et al., J Mater Res. 2007: 22; 344, the disclosures of each of which are incorporated herein by reference.) These low-cost ultra-strong materials, however, exhibit fracture toughness values as low as 3 MPa $m^{1/2}$, which are well below the lowest acceptable toughness limit for a structural material. (See, e.g., Hess P A, et al., J Mater Res. 2005: 20; 783, the disclosure of which is incorporated herein by reference.) The low toughness of these glasses has been linked to their elastic constants, specifically their high shear modulus, which for some compositions was reported to exceed 80 GPa. (See, e.g., Gu X J, et al., Acta Mater 2008: 56; 88, the disclosure of which is incorporated herein by reference.) Recent efforts to toughen these alloys by altering their elemental composition yielded glasses with lower shear moduli (below 70 GPa), which exhibit improved notch toughness (as high as 50 MPa $m^{1/2}$), but compromised glass forming ability (critical rod diameters of less than 3 mm). (See, e.g., Lewandowski J J, et al., Appl Phys Lett 2008: 92; 091918, the disclosure of which is incorporated herein by reference.)

Accordingly, a need exists for Fe-based alloys with particularly low shear moduli (below 60 GPa) that demonstrate high toughness (notch toughness in excess of 50 MPa $m^{1/2}$) yet adequate glass forming ability (critical rod diameters as large as 6 mm).

BRIEF SUMMARY OF THE INVENTION

Thus, there is provided in accordance with the current invention an iron-based bulk metallic glass alloy capable of having the highest possible toughness at the largest attainable critical rod diameter of the alloy.

In one embodiment, the composition of the invention includes at least Fe, P, C and B, where Fe comprises an atomic percent of at least 60, P comprises an atomic percent of from 5 to 17.5, C comprises an atomic percent of from 3 to 6.5, and B comprises an atomic percent of from 1 to 3.5.

In another embodiment, the composition includes an atomic percent of P of from 10 to 13.

In still another embodiment, the composition includes an atomic percent of C of from 4.5 to 5.5.

In yet another embodiment, the composition includes an atomic percent of B of from 2 to 3.

In still yet another embodiment, the composition includes a combined atomic percent of P, C, and B of from 19 to 21.

In still yet another embodiment, the composition includes Si in an atomic percent of from 0.5 to 2.5. In another such embodiment, the atomic percent of Si is from 1 to 2.

In still yet another embodiment, the composition has a combined atomic percent of P, C, B, and Si of from 19 to 21.

In still yet another embodiment, the composition further comprises Mo in an atomic percent of from 2 to 8. In another such embodiment, the atomic percent of Mo is from 4 to 6. In one such embodiment, the composition further comprises Ni in an atomic percent of from 3 to 7. In still another such embodiment, the atomic percent of Ni is from 4 to 6. In yet another such embodiment, the composition further comprises Cr in an atomic percent of from 1 to 7. In still yet another such embodiment, the composition further comprises Cr in an atomic percent of from 1 to 3. In still yet another such embodiment, the composition further comprises at least one of Co, Ru, Ga, Al, and Sb in an atomic percent of from 1 to 5.

In still yet another embodiment, the composition further comprises at least one trace element wherein the total weight fraction of said at least one trace element is less than 0.02.

In still yet another embodiment, the alloy has a glass transition temperature ($T_g$) of less than 440° C.

In still yet another embodiment, the alloy has a shear modulus (G) of less than 60 GPa.

In still yet another embodiment, the alloy has a critical rod diameter of at least 2 mm.

In still yet another embodiment, the alloy has a composition in accordance with one of the following: $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, where numbers denote atomic percent.

In another embodiment, the invention is directed to a method of manufacturing a bulk metallic glass composition as set forth herein.

In another embodiment, the invention is directed to a metallic glass object having a thickness of at least one millimeter in its smallest dimension formed of an amorphous alloy having composition as set forth herein.

BRIEF DESCRIPTION OF THE DRAWINGS

The description will be more fully understood with reference to the following figures and data charts, which are presented as exemplary embodiments of the invention and should not be construed as a complete recitation of the scope of the invention, wherein.

DETAILED DESCRIPTION OF THE INVENTION

Figure 1:
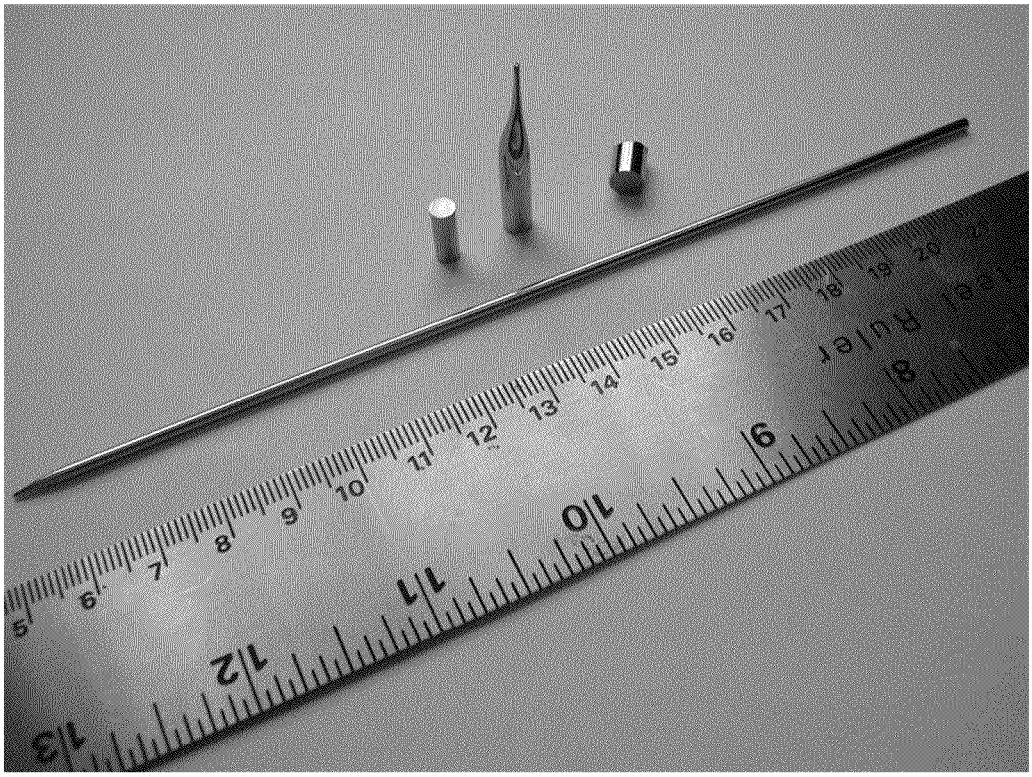
FIG. 1 presents amorphous rods of various diameters made from Fe-based alloys of the present invention.

The current invention is directed to an iron-based metallic glass having excellent processibility and toughness such that it can be used for novel structural applications. Specifically, the inventive iron-based alloy is based on the observation that by very tightly controlling the composition of the metalloid moiety of the Fe-based, P-containing bulk metallic glass alloys it is possible to obtain highly processable alloys with surprisingly low shear modulus and high toughness. Still more specifically, the Fe alloys of this invention are able to form glassy rods with diameters up to 6 mm, have a shear modulus of 60 GPa or less, and notch toughness of 40 MPa $m^{1/2}$ or more.

Definitions

Metallic Glasses: For the purposes of this invention refer to a class of metal alloys which exhibit high strength, large elastic strain limit, and high corrosion resistance owing to their amorphous nature. They are isotropic, homogeneous, and substantially free from crystalline defects. (Exemplary BMGs may be found in U.S. Pat. Nos. 5,288,344; 5,368,659; 5,618,359; and 5,735,975, the disclosure of each of which are incorporated herein by reference.)

Description

The link between high shear modulus and the low toughness of traditional. Fe-based glasses rests on the understanding that a high shear modulus designates a high resistance to accommodate stress by undergoing shear flow, which promotes cavitation and early fracture and thus limits toughness. (See, Demetriou et al., Appl Phys Lett 2009: 95; 195501, the disclosure of which is incorporated herein by reference.) Aside from their high G, the brittle behavior of these glasses can also be predicted by their high $T_g$, which for some Fe-based glasses was reported to be in excess of 600° C. (See, e.g., Lu Z P, et al., Phys Rev Lett 2004 & Ponnambalam V, et al. J Mater Res 2004, cited above.) The glass transition temperature is also a measure of the resistance to accommodate stress by undergoing shear flow. (See, Demetriou et al., Appl. Phys Lett 2009: 95; 195501, the disclosure of which is incorporated herein by reference.) Such high G and $T_g$ therefore designate a high barrier for shear flow, which explains the poor toughness of these glasses.

The family of the Fe—P—C glass-forming alloy system was first introduced by Duwez and Lin in 1967, who reported formation of glassy foils 50-mm in thickness. (See, e.g., Duwez P & Lin SCH., J Appl Phys 1967: 38; 4096, the disclosure of which is incorporated herein by reference.) Subsequent investigations revealed that glassy Fe—P—C microwires exhibit a rather high tensile and bending ductility. (See, e.g., Inoue A, et al., J Mater Sci 1982: 17; 580; and Masumoto T & Kimura H., Sci Rep Res Inst Tohoku Univ 1975: A25; 200, the disclosure of which is incorporated herein by reference.) The ductility can be associated with a relatively low $T_g$, reported to be just over 400° C., and with a relatively low G. (See, Duwez P & Lin SCH., J Appl Phys 1967, cited above.) Using the reported uniaxial yield strength of Fe—P—C of ~3000 MPa and the universal shear elastic limit for metallic glasses of 0.0267, a shear modulus of ~56 GPa can be expected. (See, e.g., Johnson W L & Samwer K. Phys Rev Lett 2005; and Masumoto T & Kimura H. Sci Rep Res Inst Tohoku Univ 1975, cited above.) Owing to such low G and $T_g$, one would expect the Fe—P—C glass to also exhibit high toughness. The plane-stress fracture toughness of glassy Fe—P—C ribbons was measured by Kimura and Masumoto to be 32 MPa $m^{1/2}$, a value substantially higher than many of the bulk glasses of the prior art. (See, e.g., Kimura H & Masumoto T. Scripta Metall 1975: 9; 211, the disclosures of each of which are incorporated herein by reference.)

In 1999 Shen and Schwarz reported development of bulk glassy alloys derived from the Fe—P—C system. (See, e.g., Shen TD & Schwarz RB., Appl Phys Lett 1999: 75; 49, the disclosure of which is incorporated herein by reference.) Specifically, they demonstrated that by substituting a fraction of C with B and fractions of Fe with Co, Cr, Mo, and Ga in a base Fe—P—C composition, glassy rods with diameters up to 4 mm could be formed. More recently, the alloy systems of (Fe,Mo)—P—(C,B), (Fe,Mo)—(P,Si)—(C,B), (Fe,Cr,Mo)—P—(C,B), (Fe,Ni,Mo)—P—(C,B), and (Fe,Co,Mo)—(P,Si)—(C,B) have been explored, all of which were found to form bulk glasses with critical rod diameters ranging from 2 to 6 mm. (See, e.g., Gu X J, et al., Acta Mater 2008: 56; 88; Zhang T, et al., Mater Trans 2007: 48; 1157; Shen B, et al., Appl Phys Lett 2006: 88; 131907; Liu F, et al., Mater Trans 2008: 49; 231; and Li F, et al., Appl Phys Lett 2007: 91; 234101, the disclosures of each of which are incorporated herein by reference.) However, the glass-transition temperatures and shear moduli of these alloys are not low. In particular, $T_g$ values as high as 470° C. and G values of nearly 70 GPa have been reported for those systems. Consequently those glasses do not demonstrate an optimum glass-forming-ability/toughness relation, that is, they do not exhibit the highest possible toughness at the largest attainable critical rod diameter.

In the instant invention it has been surprisingly discovered that by tailoring the metalloid moiety of these alloys it is possible to obtain a family of Fe-based, P-containing bulk-glass forming compositions with $T_g$ values below 440° C. and having values of G of less than 60 GPa that can be cast into rods of at least 2 mm or more, such that an optimum glass-forming ability-toughness relationship is attained.

Accordingly, in one embodiment, the composition of the alloys in accordance with the current invention may be represented by the following formula (subscripts denote atomic percent):

$$[Fe,X]_a[(P,C,B,Z)]_{100-a}$$

where:

a is between 79 and 81, and preferably, a is 80;

The atomic percent of P is between 5 and 17.5, and preferably between 11 and 12.5; the atomic percent of C is between 3 and 6.5, and preferably 5; the atomic percent of B is between 1 and 3.5, and preferably 2.5.

X is an optional metal or a combination of metals selected from Mo, Ni, Co, Cr, Ru, Al, and Ga; preferably, X is a combination of Mo, Ni, and Cr, where the atomic percent of Mo is between 2 and 8, and preferably 5, the atomic percent of Ni is between 3 and 7, and preferably 5, and the atomic percent of Cr is between 1 and 3, and preferably 2.

Z is an optional metalloid selected from Si and Sb, where the atomic percent of Z is between 0.5 and 2.5, and preferably 1.5.

Other trace elements can be added in the proposed composition formula having a total weight fraction of less than 0.02.

Using the above formulation, and particularly the novel metalloid moiety, it has been surprisingly discovered that it is possible to obtain bulk metallic glass alloys having excellent toughness, $T_g$ values below 440° C. and G of less than 60 GPa, that may be cast in amorphous rods with a critical rod diameter of 3 mm or more, and in some instances 6 mm.

Although the above composition represents one formulation of the family of iron-based phosphor containing bulk metallic glasses in accordance with the instant invention, it should be understood that alternative compositional formulations are contemplated by the instant invention.

First, because the interstitial metalloids like B and C increase glass forming ability, but also increase the shear modulus such that they degrade toughness. The effect of B and C on increasing shear modulus and degrading toughness is also known to occur in conventional (crystalline) steel alloys. In the present invention, it has been discovered that by tightly controlling the fraction of these metalloids it is possible to obtain an optimal balance between glass formation and toughness. In one such embodiment, the alloys of the instant invention include a metalloid moiety comprising of P, C, B and optionally Z, where Z can be one or both of Si and Sb, wherein the combined atomic percent (P+C+B+Z) is from 19 to 21. In such an embodiment, the atomic percent of C is from 3 to 6.5, and preferably from 4 to 6; the atomic percent of B is from 1 to 3.5, and preferably from 2 to 3; and the atomic percent of Z is from 0.5 to 2.5, and preferably from 1 to 2.

In another alternative embodiment, some portion of the Fe content can be substituted with a combination of other metals. In such an embodiment, Fe, in a concentration of more than 60 atomic percent, and preferably from 68 to 75, is substituted with Mo in a concentration of from 2 to 8, and preferably 5 atomic percent. In such a Mo-substituted alloy, the Fe may be further replaced by from 3 to 7 atomic percent, and preferably 5 atomic percent, Ni. In such a Mo and Ni-substituted alloy, the Fe may be further substituted by from 1 to 3, and preferably 2 atomic percent Cr.

Alternatively, Fe may be substituted by between 1 to 5 atomic percent of at least one of Co, Ru, Al and Ga.

Generally speaking, up to 4 atomic percent of other transition metals is acceptable in the glass alloy. It can also be noted that the glass forming alloy can tolerate appreciable amounts of several elements that could be considered incidental or contaminant materials. For example, an appreciable amount of oxygen may dissolve in the metallic glass without significantly shifting the crystallization curve. Other incidental elements such as germanium or nitrogen may be present in total amounts less than about two atomic percent, and preferably in total amounts less than about one atomic percent.

Although the above discussion has focused on the composition of the alloy itself, it should be understood that the invention is also directed to methods of forming Fe-based, P-containing bulk metallic glasses in accordance with the above formulations, and in forming articles from the inventive alloy compositions. In one such embodiment, a preferred method for producing the alloys of the present invention involves inductive melting of the appropriate amounts of constituents in a quartz tube under inert atmosphere. A preferred method for producing glassy rods from the alloys of the present invention involves re-melting the alloy ingots inside quartz tubes of 0.5-mm thick walls under inert atmosphere and rapidly water quenching. Alternatively, glassy rods can be produced from the alloys of the present invention by re-melting the alloy ingots inside quartz tubes of 0.5-mm thick walls under inert atmosphere, bringing the molten ingots in contact with molten boron oxide for about 1000 seconds, and subsequently rapidly water quenching. Amorphous Fe-based rods of various diameters made from alloys of the present invention are presented in FIG. 1.

It should be understood that the above alternative embodiments are not meant to be exclusive, and that other modifications to the basic apparatus and method that do not render the composition unprocessible (critical rod thickness of less than 1 mm), or insufficiently tough (shear modulus values of greater than 60 GPa) for structural applications can be used in conjunction with this invention.

Exemplary Embodiments

The person skilled in the art will recognize that additional embodiments according to the invention are contemplated as being within the scope of the foregoing generic disclosure, and no disclaimer is in any way intended by the foregoing, non-limiting examples.

Experimental Methods & Materials

Alloy ingots were prepared by induction melting mixtures of the appropriate amounts of Fe (99.95%), Mo (99.95%), Ni (99.995%), Cr (99.99%), B crystal. (99.5%), graphite powder (99.9995%), and P (99.9999%) in quartz tubes sealed under high-purity argon atmosphere. A 50-μm thick glassy $Fe_{80}P_{12.5}C_{7.5}$ foil was prepared using an Edmund Buhler D-7400 splat quencher. All other alloys were formed into glassy cylindrical rods by re-melting the alloy ingots in quartz tubes of 0.5-mm thick walls under high-purity argon atmosphere and rapidly water quenching. X-ray diffraction with Cu—Kα radiation was performed to verify the amorphous nature of the glassy foils and rods. Differential scanning calorimetry at a scan rate of 20 K/min was performed to determine the transition temperatures for each alloy.

The elastic constants of alloys in the present invention capable of forming amorphous rods with diameters greater than 2 mm were evaluated using ultrasonic measurements along with density measurements. Shear and longitudinal wave speeds of glassy $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ rods were measured by pulse-echo overlap using 25 MHz piezoelectric transducers. Densities were measured by the Archimedes method, as given in the American Society for Testing and Materials standard C693-93.

Notch toughness tests for alloys in the present invention capable of forming amorphous rods with diameters greater than 2 mm were performed. For the toughness tests, 2-mm diameter glassy rods of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ were utilized. The rods were prepared by re-melting alloy ingots in 2-mm ID quartz tubes of 0.5 mm thick walls under high-purity argon atmosphere and rapidly water quenching. The rods were notched using a wire saw with a root radius of 90 μm to a depth of approximately half the rod diameter. The notched specimens were placed on a 3-pt bending fixture with span distance of 12.7 mm and carefully aligned with the notched side facing downward. The critical fracture load was measured by applying a monotonically increasing load at constant cross-head speed of 0.1 mm/min using a screw-driven Instron testing frame. At least three tests were performed for each alloy. The specimen fracture surfaces were examined by scanning electron microscopy using a LEO 1550VP Field Emission SEM.

The stress intensity factor for the cylindrical configuration employed was evaluated using the analysis of Murakimi. (See, e.g., Murakami Y., Stress Intensity Factors Handbook. Vol. 2. Oxford (United Kingdom): Pergamon Press; 1987. p. 666, the disclosure of which is incorporated herein by reference.) The dimensions of the specimens are large enough to satisfy the standard size requirement for an acceptable plane-strain fracture toughness measurement, $K_{IC}$. Specifically, considering that the most frequent ligament size in the present specimens was ~1 mm, and taking the yield strength for this family of glasses to be ~3200 MPa, nominally plane strain conditions can be assumed for fracture toughness measurements of $K_{IC}$<60 MPa $m^{1/2}$, as obtained here. (See, e.g., Gu X J, et al., Acta Mater 2008; Zhang T, et al., Mater Trans 2007; Shen B, et al., Appl Phys Lett 2006; Liu F, et al., Mater Trans 2008; and Li F, et al., Appl Phys Lett 2007, cited above.) Nevertheless, since sharp pre-cracks ahead of the notches were not introduced in the present specimens (as required for standard $K_{IC}$ evaluation), the measured stress intensity factors do not represent standard $K_{IC}$ values. In this sense, direct comparison of the notch toughness, $K_Q$, evaluated in this study with standard $K_{IC}$ values for conventional metals is inappropriate. Nonetheless, $K_Q$ values provide useful information about the variation of the resistance to fracture within a set of uniformly-tested materials. Due to inherent critical-casting-thickness limitations of many newly-developed metallic glass alloys, notch toughness measurements using specimens with cylindrical geometry and no preexisting cracks are often reported for metallic-glass alloy systems. (See, e.g., Wesseling P, et al., Scripta Mater 2004: 51; 151; and Xi X K, et al., Phys Rev Lett 2005: 94; 125510, the disclosures of which are incorporated herein by reference.) More specifically, the notch toughness measurements performed recently for Fe-based bulk metallic glasses by Lewandowski et al. using specimens with configurations and dimensions similar to the present study are suitable for direct comparison with the present estimates. (See, e.g., Nouri AS, et al., Phil. Mag. Lett. 2008: 88; 853, the disclosure of which is incorporated herein by reference.)

EXAMPLE 1

Compositional Survey

Figure 2:
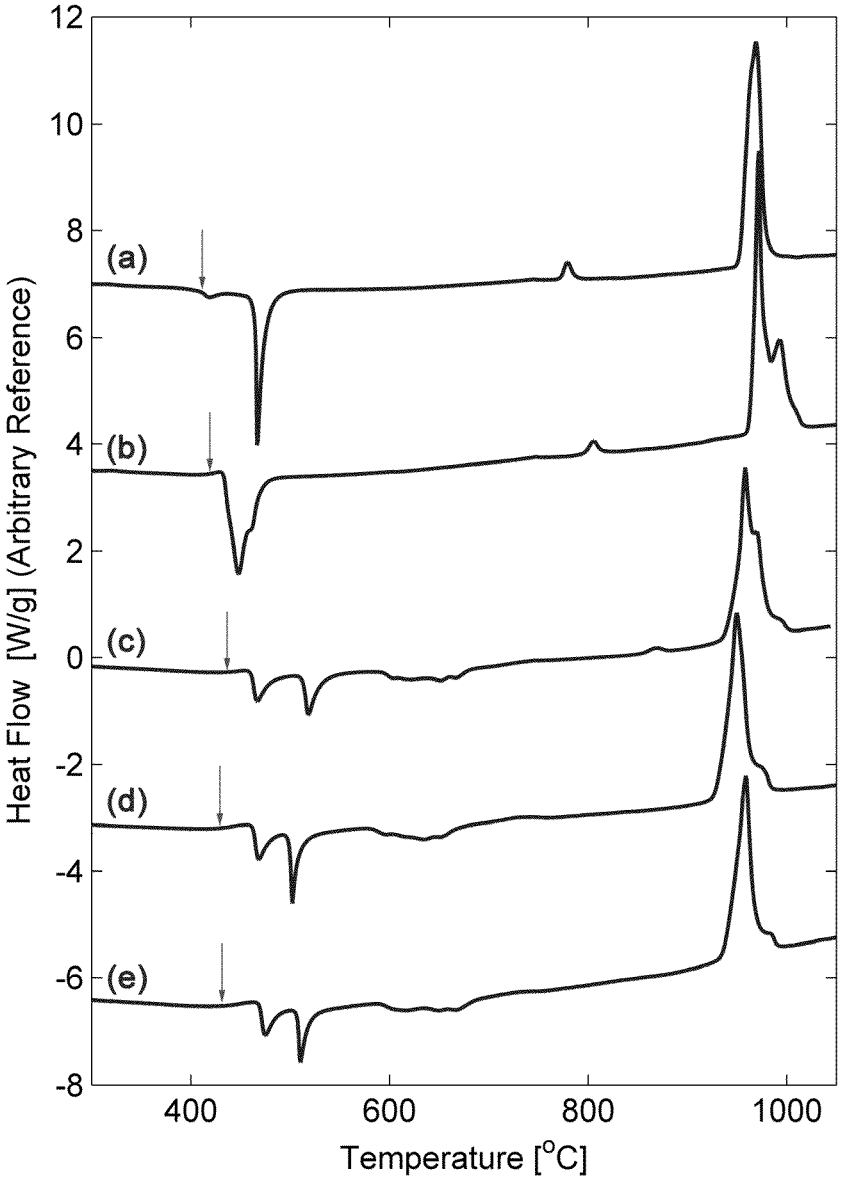
FIG. 2 provides data graphs for differential scanning calorimetry measurements conducted at 20 K/min scan rate for amorphous samples of (a) $Fe_{80}P_{12.5}C_{7.5}$ (b) $Fe_{80}P_{12.5}(C_5B_{2.5})$, (C) $(Fe_{74.5}Mo_{5.5})P_{12.5}(C_5B_{2.5})$, (d) $(Fe_{70}Mo_5Ni_5)P_{12.5}(C_5B_{2.5})$, and (e) $(Fe_{68}Mo_5Ni_5Cr_2)P_{12.5}(C_5B_{2.5})$, where the arrows designate the glass transition temperatures of each of the alloys.

Alloys developed based on this compositional survey along with the associated critical rod diameters are listed in Table 1, below. Thermal scans are presented in FIG. 2, and $T_g$ for each alloy is listed in Table 1. The measured shear and bulk moduli along with the molar volumes of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ are also listed in Table 1. As seen in Table 1, the exemplary Fe-based alloys are capable of forming glassy rods with diameters ranging from 0.5 mm to 6 mm, and exhibit shear moduli of less than 60 GPa, in accordance with the criteria set forth in this invention. It is interesting to note that substitution of 1.5% P by Si in the inventive compositions listed in Table 1 was found to slightly improve glass-forming ability. The Si-containing versions of the above compositions are $Fe_{80}(P_{11}Si_{1.5})(C_5B_{2.5})$, $(Fe_{74.5}Mo_{5.5})(P_{11}Si_{1.5})(C_5B_{2.5})$, $(Fe_{70}Mo_5Ni_5)(P_{11}Si_{1.5})(C_5B_{2.5})$, and $(Fe_{68}Mo_5Ni_5Cr_2)(P_{11}Si_{1.5})(C_5B_{2.5})$.

TABLE 1

Compositional Survey

| Composition | $T_g$ [° C.] | $d_c$ [mm] | $v_m$ [$m^3$/mol] | G [GPa] | B [GPa] | $K_Q$ [MPa $m^{1/2}$] |
|---|---|---|---|---|---|---|
| $Fe_{80}P_{12.5}C_{7.5}$ (prior art alloy) | 405 | 0.05* | — | 56† | — | 32‡ |
| $Fe_{80}P_{12.5}(C_5B_{2.5})$ | 412 | 0.5 | — | — | — | — |
| $(Fe_{74.5}Mo_{5.5})P_{12.5}(C_5B_{2.5})$ | 429 | 3 | $6.85 \times 10^{-6}$ | 56.94 ± 0.09 | 145.0 ± 0.3 | 53.1 ± 2.4 |
| $(Fe_{70}Mo_5Ni_5)P_{12.5}(C_5B_{2.5})$ | 423 | 4 | $6.89 \times 10^{-6}$ | 57.31 ± 0.08 | 150.1 ± 0.4 | 49.8 ± 4.2 |
| $(Fe_{68}Mo_5Ni_5Cr_2)P_{12.5}(C_5B_{2.5})$ | 426 | 6 | $6.87 \times 10^{-6}$ | 57.94 ± 0.07 | 149.7 ± 0.3 | 44.2 ± 4.6 |

*Critical foil thickness attainable by splat quenching or melt spinning. (See, Duwez P & Lin SCH. J Appl Phys 1967, cited above.)
†Estimated using the reported uniaxial yield strength of ~3000 MPa and the universal shear elastic limit of 0.0267. (See, Johnson WL & Samwer K. Phys Rev Lett 2005; and Masumoto T & Kimura H. Sci Rep Res Inst Tohoku Univ 1975, cited above.)
‡Plane-stress fracture toughness measured by "trouser-leg" type shear tests. (See, Kimura H, Masumoto T. Scripta Metall 1975, cited above.)

Figure 3:
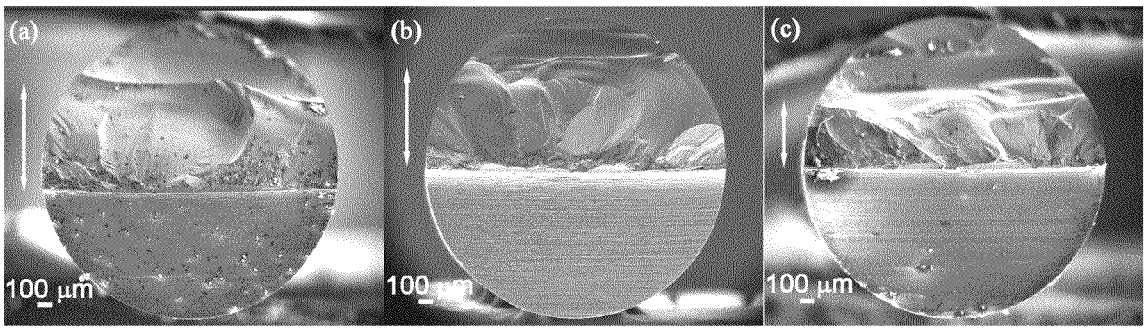
FIG. 3 provides scanning electron micrographs of the fracture surfaces of amorphous specimens of composition (a) $(Fe_{74.5}Mo_{5.5})P_{12.5}(C_5B_{2.5})$, (b) $(Fe_{70}Mo_5Ni_5)P_{12.5}(C_5B_{2.5})$, and (c) $(Fe_{68}Mo_5Ni_5Cr_2)P_{12.5}(C_5B_{2.5})$, where the arrows designate the approximate width of the "jagged" region that develops adjacent to the notch of each specimen.

The measured notch toughness $K_Q$ of $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ along with quoted errors representing standard deviations in values are presented in Table 1. Despite the relatively large uncertainty ranges, which can be attributed to processing defects that often exceed the relatively small plastic zone size of these glasses, the data reveal a monotonically decreasing trend in $K_Q$ in going from the most modest to the best glass former. (See, e.g., Nouri AS, et al., Phil. Mag. Lett. 2008: 88; 853, the disclosure of which is incorporated herein by reference.) This trend is also reflected by the fracture-surface morphologies of the tested specimens shown in the micrographs of FIG. 3. The fracture surfaces of these alloys reveal rough "jagged" patterns at the beginning stage of crack propagation, followed by the characteristic dimple pattern typical of brittle glassy metal fracture. (See, e.g., Suh JY. PhD Dissertation, California Institute of Technology 2009, the disclosure of which is incorporated herein by reference.) The extent of such jagged regions ahead of the typical dimple morphology suggests that substantial plastic flow occurred prior to catastrophic fracture, which supports the relatively high $K_Q$ values. More interestingly, the width of these jagged regions (approximated by arrows in FIG. 3) decreases on going from tougher to more brittle alloys, suggesting that the width of the jagged region roughly scales with $K_Q$, or more appropriately, with the characteristic plastic zone size of the material. The existence of such a scaling relation has also been noted by Suh (cited above).

EXAMPLE 2

Toughness-Glass-Forming Ability Relation for the Inventive Alloys

Figure 4:
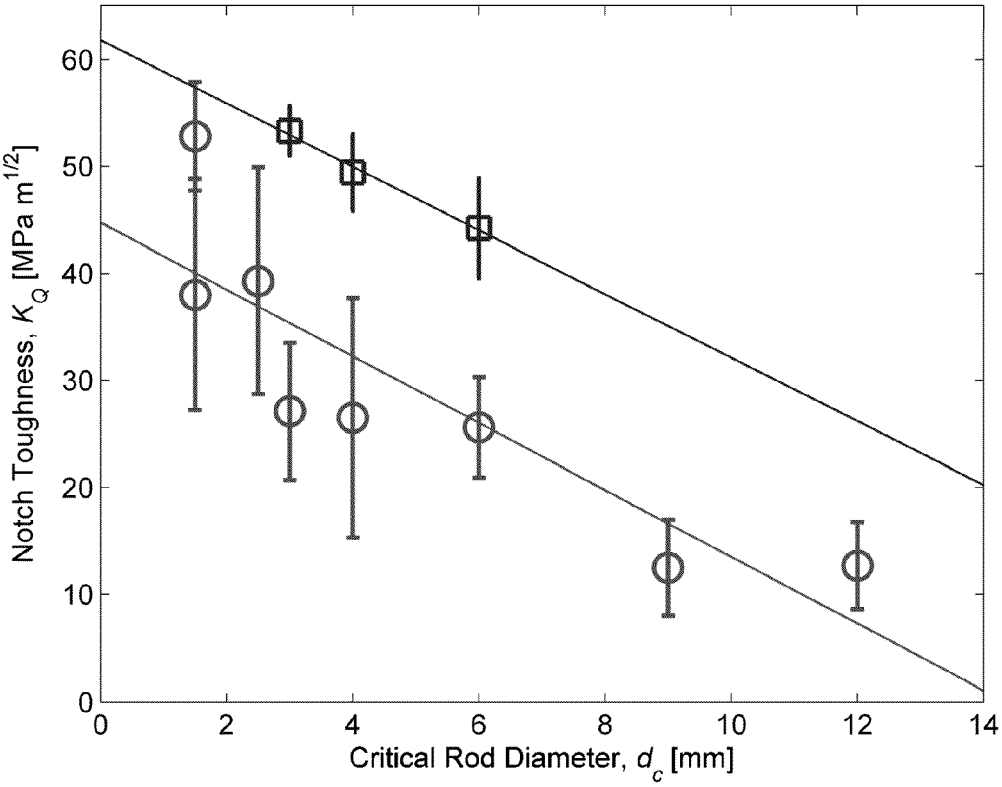
FIG. 4 provides a data graph plotting notch toughness vs. critical rod diameter for amorphous $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$ (□), and for the Fe-based glasses developed by Poon and co-workers [Ponnambalam V, et al., J Mater Res 2004: 19; 1320; Gu X J, et al., J Mater Res. 2007: 22; 344; Gu X J, et al., Acta Mater 2008: 56; 88; and Gu X J, et al., Scripta Mater 2007: 57; 289, the disclosure of which are incorporated herein by reference] and investigated by Lewandowski and co-workers [Lewandowski J J, et al., Appl Phys Lett 2008: 92; 091918; and Nouri AS, et al., Phil. Mag. Lett. 2008: 88; 853, the disclosures of which are incorporated herein by reference] (○), where the lines are linear regressions to the data.

In FIG. 4 the trend of decreasing toughness with increasing glass-forming ability is exemplified by plotting the notch toughness $K_Q$ against the critical rod diameter $d_c$ for $(Fe_{74.5}Mo_{5.5})P_{12.5}(C_5B_{2.5})$, $(Fe_{70}Mo_5Ni_5)P_{12.5}(C_5B_{2.5})$, and $(Fe_{68}Mo_5Ni_5Cr_2)P_{12.5}(C_5B_{2.5})$. Interestingly, the plot reveals that this trend is roughly linear. On the same plot we also present $K_Q$ vs. $d_c$ data for the Fe-based glassy alloys developed by Poon and co-workers (cited above), and investigated by Lewandowski and co-workers (cited above). A linear regression through the data reveals a toughness vs. glass-forming ability correlation of similar slope but lying well below the correlation demonstrated by the present data.

Figure 5:
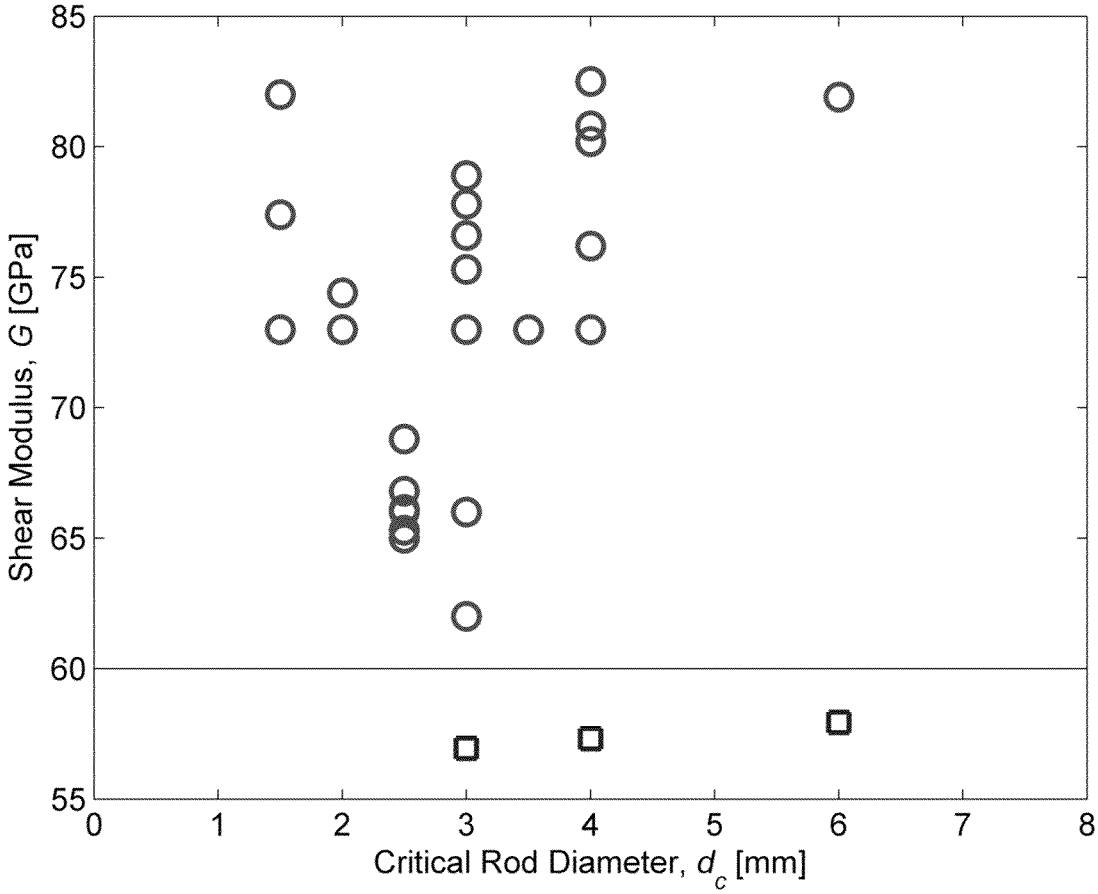
FIG. 5 provides a data graph plotting shear modulus vs. critical rod diameter for amorphous $(Fe_{74.5}Mo_{5.5})(P_{12.5}C_5B_{2.5})$, $(Fe_{70}Mo_5Ni_5)(P_{12.5}C_5B_{2.5})$, and $(Fe_{68}Mo_5Ni_5Cr_2)(P_{12.5}C_5B_{2.5})$ (□), and for the Fe-based glasses developed by Poon and co-workers (cited above) (○), it should be noted that alloys of this invention exhibit shear modulus less than 60 GPa (designated by line) at critical rod diameters comparable to the alloys of the prior art.

The much higher toughness for a given critical rod diameter exhibited by the inventive alloys compared to prior art alloys is attributed to their much lower shear modulus. (See Demetriou et al. cited above.) The compositional investigations that led to glass formation of the prior art alloys was performed without seeking to minimize shear modulus and hence maximize toughness. Specifically, the fractions of C and B in the prior art alloys are high such that they give rise to a high shear modulus which promotes low toughness. All alloys in the prior art capable of forming bulk glassy rods comprise materials in which at least one or both of C and B have atomic percentages greater than 6.5 and 3.5, respectively. By contrast, in the present invention the fractions of C and B were carefully controlled such that they are high enough to promote glass formation, yet low enough to enable a low shear modulus and promote a high toughness. Alloy compositions in the present invention capable of forming bulk glassy rods comprise C and B at atomic percentages not less than 3 and 1, and not more than 6.5 and 3.5, respectively. Maintaining the atomic percentages of C and B within those ranges enables bulk-glass formation while maintaining a low shear modulus, which promotes a high toughness. This is exemplified in FIG. 5, where the shear modulus of the inventive alloys as well as those of the prior art are plotted against their respective critical rod diameters. A much lower shear modulus is revealed for the inventive alloys at a given critical rod diameter, which is the origin of their much higher toughness at a given rod diameter, as revealed in FIG. 4.

CONCLUSION

In summary, the inventive Fe-based, P-containing metallic glasses demonstrate an optimum toughness-glass forming ability relation. Specifically, the inventive alloys demonstrate higher toughness for a given critical rod diameter than any other prior art alloys. This optimum relation, which is unique in Fe-based systems, is a consequence of a low shear modulus achieved by very tightly controlling the fractions of C and B in the compositions of the inventive alloys.

The unique combination of high glass-forming ability and toughness associated with the inventive alloys make them excellent candidates for use as structural elements in a number of applications, specifically in the fields of consumer electronics, automotive, and aerospace. In addition to a good glass-forming ability and toughness, the inventive Fe-based alloys demonstrate a higher strength, hardness, stiffness, and corrosion resistance than commercial. Zr-based glasses, and are of much lower cost. Therefore, the inventive alloys are well suited for components for mobile electronics requiring high strength, stiffness, and corrosion and scratch resistance, which include but are not limited to casing, frame, housing, hinge, or any other structural component for a mobile electronic device such as a mobile telephone, personal digital assistant, or laptop computer. In addition, these alloys do not contain elements that are known to cause adverse biological reactions. Specifically, they are free of Cu and Be, and certain compositions can be formed without Ni or Al, all of which are known to be associated with adverse biological reactions. Accordingly, it is submitted that the inventive materials could be well-suited for use in biomedical applications, such as, for example, medical implants and instruments, and the invention is also directed to medical instruments, such as surgical instruments, external fixation devices, such as orthopedic or dental wire, and conventional implants, particularly load-bearing implants, such as, for example, orthopedic, dental, spinal, thoracic, cranial implants made using the inventive alloys. The combination of high scratch and corrosion resistance, biocompatibility, and an attractive "white" color make the alloy well suited for jewelry applications, such as, for example, watches, rings, necklaces, earrings, bracelets, cuflinks, as well as casings and packaging for such items. Finally, these materials also demonstrate soft ferromagnetic properties, indicating that they would be well suited for applications requiring soft magnetic properties, such as, for example, in electromagnetic shielding or transformer core applications.

DOCTRINE OF EQUIVALENTS

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. An Fe-based metallic glass composition comprising at least Fe, Mo, P, C and B, where Fe comprises an atomic percent of at least 60, Mo comprises an atomic percent of from 2 to 8, P comprises an atomic percent of from 5 to 17.5, C comprises an atomic percent of from 3 to 6.5, and B comprises an atomic percent of from 1 to 3.5, wherein the composition has a shear modulus (G) of less than 60 GPa and a glass transition temperature ($T_g$) of less than 440° C., and the composition is capable of forming a bulk amorphous object having a critical thickness of at least 2 mm.

2. The metallic glass of claim 1, wherein the atomic percent of P is from 10 to 13.

3. The metallic glass of claim 1, wherein the atomic percent of C is from 4.5 to 5.5.

4. The metallic glass of claim 1, wherein the atomic percent of B is from 2 to 3.

5. The metallic glass of claim 1, wherein the combined atomic percent of P, C, and B is from 19 to 21.

6. The metallic glass of claim 1, wherein the composition further comprises Si in an atomic percent of from 0.5 to 2.5.

7. The metallic glass of claim 6, wherein the atomic percent of Si is from 1 to 2.

8. The metallic glass of claim 7, wherein the combined atomic percent of P, C, B, and Si is from 19 to 21.

9. The metallic glass of claim 1, wherein the atomic percent of Mo is from 4 to 6.

10. The metallic glass of claim 1, wherein the composition further comprises Ni in an atomic percent of from 3 to 7.

11. The metallic glass of claim 10, wherein the atomic percent of Ni is from 4 to 6.

12. The metallic glass of claim 1, wherein the composition further comprises Cr in an atomic percent of from 1 to 7.

13. The metallic glass of claim 12, wherein the composition further comprises Cr in an atomic percent of from 1 to 3.

14. The metallic glass of claim 1, wherein the composition further comprises at least one of Co, Ru, Ga, Al, and Sb in an atomic percent of from 1 to 5.

15. The metallic glass of claim 1, further comprising at least one trace element wherein the total weight fraction of said at least one trace element is less than 0.02.

16. The metallic glass of claim 1, wherein the glass transition temperature ($T_g$) is measured at a heating rate of 20 K/min using differential scanning calorimetry.

17. The metallic glass alloy of claim 1, wherein the composition is selected from the group consisting of $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, where numbers denote atomic percent.

18. A method of manufacturing a metallic glass composition comprising:

providing a feedstock material comprising at least Fe, Mo, P, C and B, where Fe comprises an atomic percent of at least 60, Mo comprises an atomic percent of from 2 to 8, P comprises an atomic percent of from 5 to 17.5, C comprises an atomic percent of from 3 to 6.5, and B comprises an atomic percent of from 1 to 3.5; and melting said feedstock into a molten state; and quenching said molten feedstock at a cooling rate sufficiently rapid to prevent crystallization of said alloy, wherein the composition has a shear modulus (G) of less than 60 GPa and a glass transition temperature ($T_g$) of less than 440° C., and the composition is capable of forming a bulk amorphous object having a critical thickness of at least 2 mm.

19. A metallic glass object comprising: a body formed of a metallic glass alloy comprising at least Fe, Mo, P, C and B, where Fe comprises an atomic percent of at least 60, Mo comprises an atomic percent of from 2 to 8, P comprises an atomic percent of from 5 to 17.5, C comprises an atomic percent of from 3 to 6.5, and B comprises an atomic percent of from 1 to 3.5, wherein the composition has a shear modulus (G) of less than 60 GPa and a glass transition temperature ($T_g$) of less than 440° C., and the composition is capable of forming a bulk amorphous object having a critical thickness of at least 2 mm.

20. The object of claim 19, wherein the object is a structural component for a consumer electronics product.

21. The object of claim 20, wherein the structural component is selected from the group consisting of a casing, frame, housing and hinge.

22. The object of claim 19, wherein the object is a structural component for biomedical applications.

23. The object of claim 22, wherein the structural component is selected from the group consisting of a biomedical implant, a fixation device and an instrument.

24. The object of claim 19, wherein the object is a jewelry item.

25. The object of claim 24, wherein the jewelry item is selected from the group consisting of a watch, ring, necklace, earring, bracelet, cufflink, and a casing or packaging for such items.

26. The object of claim 19, wherein the object is a soft magnetic article for power transformer applications.

27. The object of claim 26, wherein the soft magnetic article is selected from the group consisting of a transformer core, switch, choke and inverter.

* * * * *